US005791604A

United States Patent [19]

Nielsen et al.

[11] Patent Number: 5,791,604

[45] Date of Patent: Aug. 11, 1998

[54] SIGNAL APPARATUS INCLUDING IMPROVED ACCESS CAPABILITIES

[75] Inventors: Robert M. Nielsen; Donald L. Gibson, both of Newnan, Ga.

[73] Assignee: Serrmi Products, Inc., Atlanta, Ga.

[21] Appl. No.: 791,817

[22] Filed: Jan. 30, 1997

[51] Int. Cl.[6] ..... B61L 5/00

[52] U.S. Cl. ..... 246/473.3

[58] Field of Search ..... 246/10, 14, 16, 246/17, 18, 217, 473 R, 473.1, 473.3, 473.2, 474, 475, 476, 477, 478, 479, 480, 481, 482, 483, 484, 485

[56] References Cited

U.S. PATENT DOCUMENTS

| | | | |
|---|---|---|---|
| 284,716 | 9/1883 | Blodgett et al. | 246/484 |
| 906,707 | 12/1908 | Hall | 246/480 |
| 1,363,566 | 12/1920 | Churchill | 246/473.3 |

FOREIGN PATENT DOCUMENTS

| | | | |
|---|---|---|---|
| 74733 | 8/1929 | Germany | 246/483 |

OTHER PUBLICATIONS

General Railway Signal Catalog, dated Jun. 1988, including copies of catalog cover, contents page, pp. 73–1, 73–12, 76–1, 76–2 and 76–14.

Safetran Systems Calatog, dated Nov. 1996, including copies of catalog cover sheet, contents page, section C, pp. C–1–, C–1–2, C–8–1, C–9–1, C–10–1.

Union Switch & Signal Price List, dated Jan. 1, 1996, including catalog cover, pp. 6, 71.

*Primary Examiner*—Mark Tuan Le

*Attorney, Agent, or Firm*—Jones & Askew

[57] ABSTRACT

A railroad signal apparatus which includes a releasable joint which facilitates the servicing of railroad signal heads, particularly the servicing of signal lights mounted therein. The apparatus provides a signal head apparatus which is safe to operate and maintain, yet is still cost-effective to manufacture, operate, and maintain.

34 Claims, 2 Drawing Sheets

SIGNAL APPARATUS INCLUDING IMPROVED ACCESS CAPABILITIES

TECHNICAL FIELD

This invention relates in general to railroad signal apparatuses, and particularly relates to railroad signal apparatus which include at least one releasable joint which facilitates the servicing of railroad signal heads, particularly the servicing of signal lights mounted therein.

BACKGROUND OF THE INVENTION

In the railroad industry, it is often desirable to provide visual signals to train operators and other related personnel regarding track settings, conditions, and permissions. For example, signals can be provided to indicate that the track is clear or occupied, or if certain precautionary measures should be taken while using the track, such as maintaining a reduced speed. It is further known in the railroad industry to provide such visual signals by means of stationary apparatuses which include lights and/or other visual signal means which, upon proper interpretation by the viewer, make known such settings conditions, and permissions.

One type of conventional apparatus is that of a signal head apparatus, which is a substantially rigid structure which includes one or more lights mounted within one or more "signal heads", with the signal head mounted in a location which is readily viewable by the train operator. The signal heads are typically electrically powered by electrical lines leading thereto.

As noted above, the signal heads and their associated lights must be located where they are readily visible by train operators. In many cases, it is desirable to locate such signal heads high above the ground to facilitate easy viewing. This can be especially desirable if the signal apparatus is located adjacent a hill.

Difficulties arise when the signal heads require servicing, such as when their light bulbs require replacement.

Such difficulties are especially evident when the signal heads are located high above the ground, out of the reach of a typical human being.

In order to accommodate this problem, the prior art has developed to include apparatuses which include ladders, often used in conjunction with platforms, or to require the use of separate ladders by the service personnel. Obviously, the use of ladders introduces an element of danger which is undesirable. Platforms, which may be somewhat safer, still include some element of danger, especially if a ladder is used atop a platform.

Therefore, it may be seen that a need exists in the art for a railroad signal head apparatus which is safe to operate and maintain, yet is still cost-effective to manufacture, operate, and maintain.

SUMMARY OF THE INVENTION

The present invention overcomes deficiencies in the prior art by providing a signal head apparatus which is safe to operate and maintain, yet is still cost-effective to manufacture, operate, and maintain.

Generally described, the present invention provides an apparatus for providing signals to a train, comprising a frame means, light signal support means, and pivot means for pivoting the light signal apparatus from an operating position to a servicing position, the servicing position being lower than the operating position.

The present invention also provides an apparatus for providing signals to a train, comprising a frame means, upper and lower signal head, T-shaped light signal support means including an elongate support having an upper and lower end supporting the upper and lower signal heads, respectively, and pivot means for pivoting the T-shaped light signal support means and the upper and lower signal heads as a unit such that the upper signal head is lowered and the lower signal head is raised.

Finally, the present invention provides an apparatus for providing signals to a train, comprising a frame means, light signal support means, and pivot means for moving the light signal apparatus from an operating position to a servicing position, the servicing position being lower than the operating position, the pivot means defining an internal elongate cavity configured to accept electrical wiring therethrough.

Therefore, it is an object of the present invention to provide an improved signal apparatus for use in railroad signal applications.

It is a further object of the present invention to provide an improved railroad signal apparatus.

It is a further object of the present invention to provide an improved railroad signal apparatus which is safe to maintain.

It is a further object of the present invention to provide an improved railroad signal apparatus which is safe to operate.

It is a further object of the present invention to provide an improved railroad signal apparatus which is cost-effective to manufacture.

It is a further object of the present invention to provide a railroad signal apparatus which is cost-effective to maintain.

It is a further object of the present invention to provide a railroad signal apparatus which is cost-effective to operate.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Reference is now made to the drawings, in which like numerals represent like elements throughout the several views.

General Discussion

Figure 1:
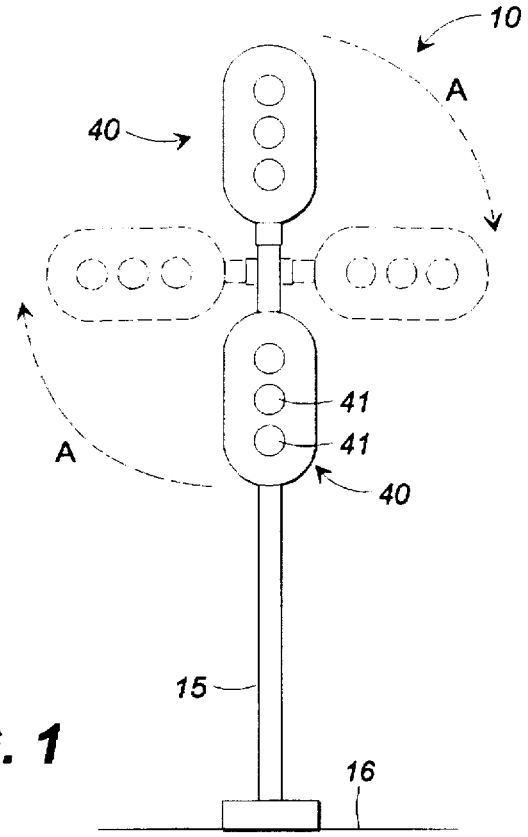
FIG. 1 is a front elevational view of the apparatus according to the present invention.
Figure 2:
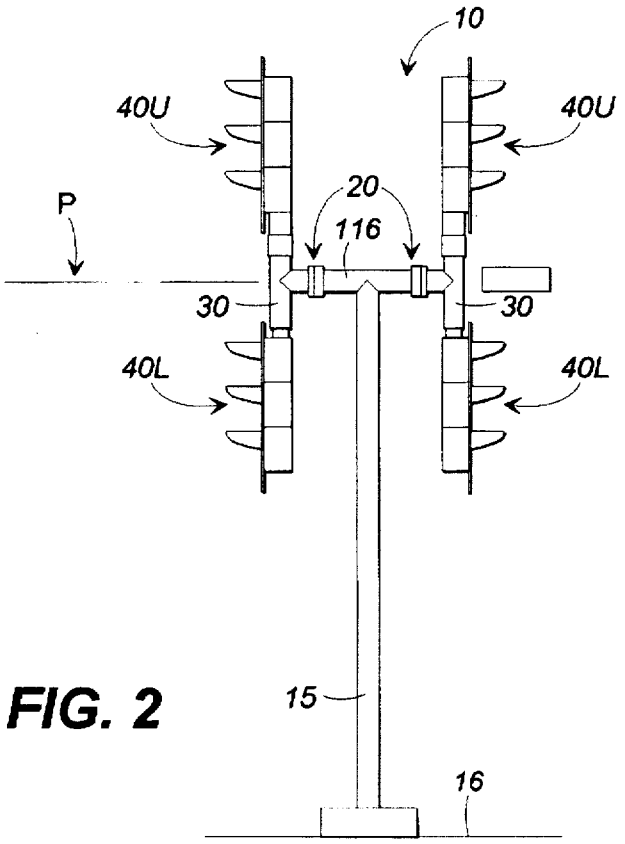
FIG. 2 is a side elevational view of the apparatus according to the present invention.
Figure 3:
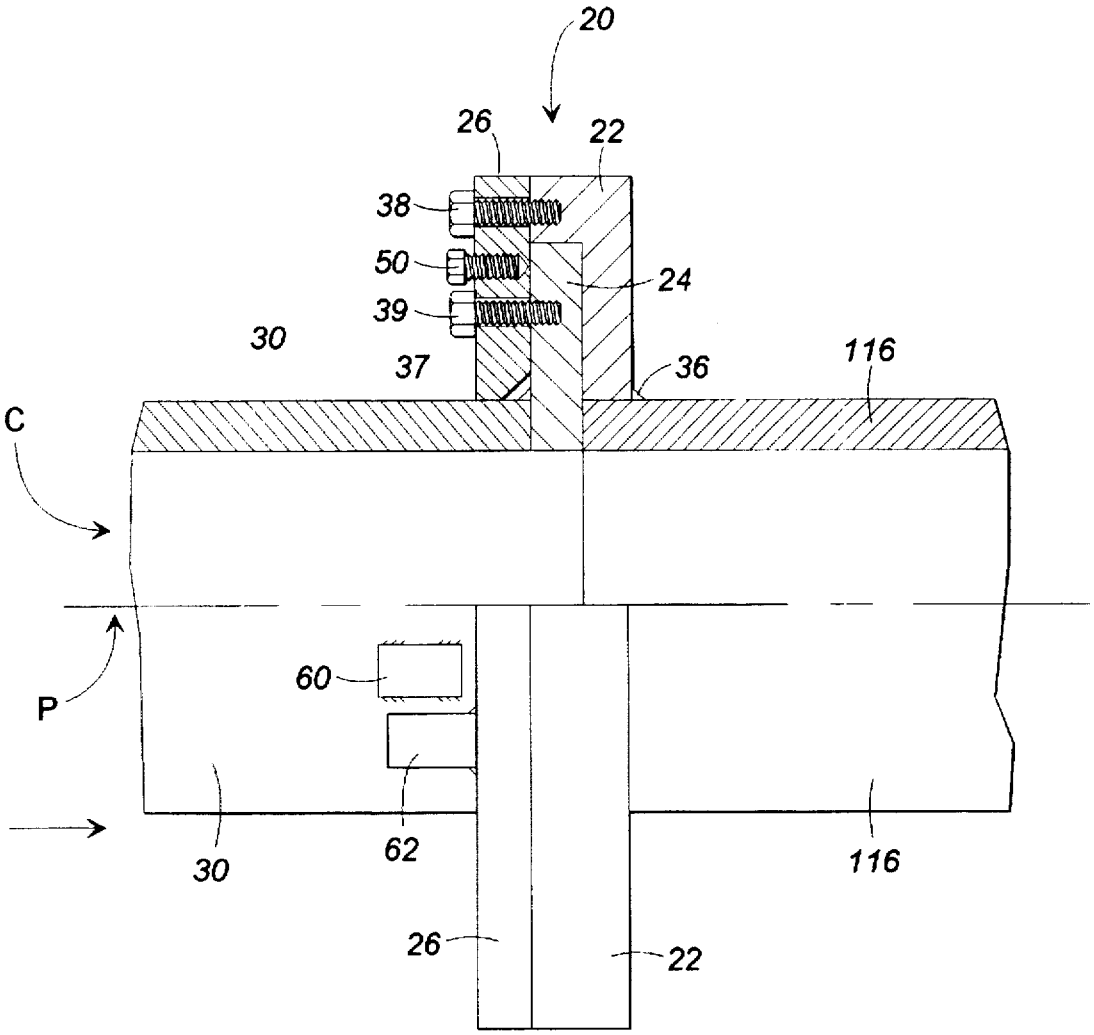
FIG. 3 is a side partially cut away elevational view of a section of the apparatus 10, including the joint 20 according to the present invention.

Generally referring to FIGS. 1–3, the signal apparatus 10 includes a main mast 15, a fixed horizontal member 116, a pair of joints 20, a corresponding pair of T-shaped members 30, and four signal heads 40. By manipulating the independent joints 20 as described later in this application, the signal heads can be pivoted as shown by the arrows A in FIG. 1 about the pivot axis P shown in FIG. 2, such that signal heads which would not otherwise be accessible are accessible. The pivot axis P is substantially common to the longitudinal axis of the elongate, tubular horizontal member 116.

Construction

As noted above, the signal apparatus 10 includes a main mast 15, a stationary horizontal member 116, a pair of pivot joints 20, a corresponding pair of T-shaped members 30, and four signal heads: two "upper" signal heads 40U and two "lower" signal heads 40L.

The main mast 15 is elongate, rigid, hollow, and extends upwardly from the supporting surface 16, which can be the ground, or can alternately be a raised surface including the roof of a building.

As noted above, the apparatus 10 includes two T-shaped members 30. To each T-shaped member 30 is attached an upper signal head 40U, and a lower signal head 40L. The upper and lower signal heads 40U, 40L, are substantially rigidly attached to the T-shaped member.

Each T-shaped member 30 includes an elongate horizontal portion and an elongate transverse portion. The horizontal "stem" portion of the T-shaped member 30 includes a longitudinal axis which is substantially common to the pivoting axis P regardless of the state of the pivoting described elsewhere. The interior end of the horizontal portion of the T-shaped member 30 is attached to the pivoting joint described elsewhere. The exterior end of the horizontal portion of each T-shaped member 30 is attached to a corresponding medial portion of the transverse portion of the T-shaped member 30.

The elongate transverse portion of the T-shaped member 30 has a longitudinal axis, which is substantially perpendicular to the pivoting axis regardless of the state of the pivoting, and has each end attached to a corresponding signal head 40.

Referring now particularly to FIG. 3, each of the two joints 20 is configured to join one end of the stationary horizontal member 116 to the horizontal portion of an associated T-shaped member 30, such that they are in a substantially abutting relationship with their longitudinal axes substantially common with each other and the pivoting axis P. The two joints 20 act independently.

Each joint 20 (a.k.a. "pivot") includes a cupped flange 20, a flat flange 24, a retaining ring 26, and accompanying fastening hardware.

The cupped flange 22 is rigidly welded to each end of the fixed horizontal member, and defines a central hole therethrough. The cupped flange is stationary and does not pivot.

The flat flange 24 likewise defines a central hole therethrough, and is shaped essentially like a large flat washer. The flat flange 24 is rigidly welded to a corresponding T-shaped member 30 by a weld 36, and when in its assembled location fits within the "cup" defined by a corresponding cupped flange 22.

The retaining ring 26 is likewise shaped essentially like a large flat washer, except that one inner circular edge is beveled as shown in FIG. 2 to provide for clearance of a weld 37. When installed, the retaining ring 26 is rigidly attached to the cupped flange 22 such that the flat flange 24 is captured between the cupped flange 22 and the retaining ring 26, as shown best in FIG. 3. The attachment between the elements 26, 22 is provided by fasteners such as 38, although other fastening means are contemplated without departing from the spirit and scope of the present invention.

When in their installed positions, the cupped flange 22, flat flange 24, and retaining ring are mounted such that their shapes are substantially symmetrical about the pivoting axis P, with the exceptions of various fastener holes and stops discussed below.

As noted above, the flat flange 24 is captured between the cupped flange 22 and the retaining ring 26. However, the various elements are constructed such that the flat flange 24 is free to rotate about the pivot axis P, unless fasteners such as 39 are provided to provide a fixed but detachable connection between the elements 24, 26. Such rotation allows for the pivoting action of the joint as discussed elsewhere.

As may be seen, the joint 20 provides an elongate internal cavity C providing a passageway from the vertical member 16 to the T-shaped member 30. Electrical wiring (not shown) supplies electricity to power the lights 42 in the signal heads 40.

A drag screw 50 is provided which provides selectable drag against the surface of the flat flange 24, to allow for selective resistance to pivoting as desired. The drag screw is stainless steel and includes a nylon tip for providing such selective resistance.

Operation

By manipulating the joints 20 as described later in this application, the signal heads can be rotated as shown by the arrows A in FIG. 1 about axis P in FIG. 2.

Typical operation of the joint 20 according to the present invention is now discussed. A service person, capable of reaching the joint, accesses the joint and removes the fasteners 39 (two in the preferred embodiment). The service person then pivots the entire subassembly comprising a T-shaped member and two signal heads such that the upper signal head is accessible. The upper signal head can then be serviced. The apparatus can then be repivoted such that it resumes its original operating position whereupon the fasteners 39 are reinstalled.

Stops are used to prevent the apparatus from rotating a complete revolution about axis P, which could cause twisting damage to the wires therein, or possibly pose a danger threat. One stop 60 is attached to the T-shaped member 30 and two other stops (one shown as 62) are attached to the retaining ring 26.

Materials and Surface Treatment

The materials used to fabricate the main mast 15, fixed vertical member 16, joint 20, and T-shaped member 30, are all made of aluminum.

In order to prevent "galling" between the aluminum surfaces in contact, the coating used is a thermoplastic fluorpolymer which has excellent non-stick properties and long life in such an application. This coating can be such as Tempcoat 3001/11 such as provided by Impreglon.

Alternatives

It may be understood that various alternatives are possible within the spirit and scope of the present invention. For example, different numbers of signal heads 40 could be used instead of the four-head design shown in the figures. Likewise, different signal heads themselves could be used, which could use configurations other than the three-light configurations shown in the drawings.

Furthermore, different fastening means could be used other than the threaded machine screws illustrated in the drawings. Different pivoting configurations could also be used within the general invention of providing a pivoting structure, although the particular pivoting means is likewise inventive. As noted above, the apparatus could be mounted atop the ground, or could also be mounted atop a separate structure. It should also be noted that a configuration not part of the present invention could also be used to mount the horizontal member 16 such that it can be selectively moved up and down along the mast 15 for even easier access. Different materials could also be used.

Conclusion

Therefore it may be seen that the present invention provides an improved signal head support apparatus which is safe to operate and maintain, yet is still cost-effective to manufacture, operate, and maintain.

While this invention has been described in specific detail with reference to the disclosed embodiments, it will be understood that many variations and modifications may be effected within the spirit and scope of the invention as described in the appended claims.

What is claimed is:

1. A light signal apparatus for providing signals to a train, comprising:

substantially stationary frame means;

pivotable light signal support means;

pivot means interconnecting said frame means and said support means to allow for pivoting said support means from an operating position to a servicing position, said servicing position being lower than said operating position; and stop means for allowing said pivoting to occur about a longitudinal axis within but not exceeding a 360 degree range.

2. The apparatus as claimed in claim 1, further comprising adjustable drag means for providing adjustable drag upon said pivot means as it is being pivoted.

3. The apparatus as claimed in claim 2, further comprising releasable lock means for selectively preventing said pivoting of said support means.

4. An apparatus for providing signals to a train, comprising:

substantially stationary frame means;

upper and lower signal heads;

pivotable T-shaped light signal support means including an elongate support having an upper and lower end supporting said upper and lower signal heads, respectively;

pivot means interconnecting said frame means and said support means to allow for pivoting said T-shaped light signal support means and said upper and lower signal heads as a unit such that when said upper signal head is lowered and said lower signal head is raised; and stop means for allowing said pivoting to occur about a longitudinal axis within but not exceeding a 360 degree range.

5. The apparatus as claimed in claim 4, further comprising adjustable drag means for providing adjustable drag upon said pivot means as it is being pivoted.

6. The apparatus as claimed in claim 5, further comprising releasable lock means for selectively preventing said pivot means to operate.

7. The apparatus as claimed in claim 5, wherein said pivot means includes a retaining ring, a cupped flange, and a captured flange, said captured flange being attached to one of said stationary frame means and said support means, said cupped flange being attached to the other of said stationary frame means and said support means, and said retaining ring being configured to capture said captured flange in said cupped flange while still allowing said captured flange to be pivoted relative to said cupped flange.

8. The apparatus as claimed in claim 7, further comprising removable fasteners to selectively fix said retaining ring relative to said cupped flange to provide an enclosure for said captured flange.

9. The apparatus as claimed in claim 8, further comprising capturing fasteners to selectively capture said captured flange relative to said retaining ring but detachable to allow said captured flange to be selectively detached from said retaining ring.

10. An apparatus for providing signals to a train, comprising:

a stationary frame means;

a pivotable light signal support means; and pivot means interconnecting said frame means and said support means to allow for pivotably moving said light signal support means from an operating position to a servicing position, said servicing position being lower than said operating position, said pivot means defining an internal elongate cavity configured to accept electrical wiring therethrough passing from said stationary frame means to said pivotable signal support means.

11. The apparatus as claimed in claim 10, wherein said pivot means has a pivot passing through said internal elongate cavity.

12. The apparatus as claimed in claim 10, wherein said pivot means includes a retaining ring, a cupped flange, and a captured flange, said captured flange being attached to one of said stationary frame means and said support means, said cupped flange being attached to the other of said frame means and said support means, and said retaining ring being configured to capture said captured flange in said cupped flange while still allowing said captured flange to be pivoted relative to said cupped flange.

13. The apparatus as claimed in claim 12, further comprising removable fasteners to selectively fix said retaining ring relative to said cupped flange to provide an enclosure for said captured flange.

14. The apparatus as claimed in claim 12, further comprising capturing fasteners to selectively capture said captured flange relative to said retaining ring but detachable to allow said captured flange to be selectively detached from said retaining ring.

15. The apparatus as claimed in claim 14, further comprising removable fasteners to selectively fix said retaining ring relative to said cupped flange to provide an enclosure for said captured flange.

16. An apparatus for providing signals to a train, comprising:

A) a substantially stationary frame;

B) a signal head containing at least one replaceable signal light;

C) a pivoting signal head supporting member rigidly attached relative to and supporting said signal head, and D) a pivoting connection intermediate said substantially stationary frame and said pivoting signal head supporting member, said pivoting connection configured to allow selective movement of said signal head from an operating position to a servicing position, said servicing position being lower than said operating position, said pivot connection defining an internal elongate cavity configured to accept electrical wiring therethrough, said pivoting connection itself comprising;

1) a retaining ring, 2) a cupped flange, and 3) a captured flange, said captured flange being attached to one of said frame and said supporting member, said cupped flange being attached to the other of said frame and said supporting member, and said retaining ring being configured to capture said captured flange in said cupped flange while still allowing said captured flange to be pivoted relative to said cupped flange.

17. The apparatus as claimed in claim 16, further comprising stop means for allowing said supporting member to pivot about a longitudinal axis within but not exceeding a 360 degree range.

18. The apparatus as claimed in claim 17, further comprising adjustable drag means for providing adjustable drag upon said pivoting head supporting member as said supporting member is being pivoted.

19. The apparatus as claimed in claim 16, further comprising adjustable drag means for providing adjustable drag upon said pivoting head supporting member as said supporting member is being pivoted.

20. The apparatus as claimed in claim 18, further comprising releasable lock means for selectively preventing said pivoting head supporting member from pivoting.

21. An apparatus for providing signals to a train, comprising:

a substantially stationary frame;

a signal head for containing at least one replaceable signal light; and a pivoting signal head supporting member rigidly attached relative to and supporting said signal head, said pivoting signal head supporting member being pivotably mounted relative to said substantially stationary frame through a pivoting connection, said pivoting connection configured to allow selective pivoting movement of said signal head from an operating position to a servicing position, said servicing position being lower than said operating position, said pivoting connection also defining an internal elongate cavity configured to accept electrical wiring therethrough, said elongate cavity partially defined by said stationary frame and partially defined by said signal head supporting member.

22. The apparatus as claimed in claim 21, wherein said signal head supporting member is generally "T"-shaped.

23. The apparatus as claimed in claim 21, wherein said signal head supporting member and said stationary frame are generally tubular proximate said pivoting connection, such that a generally cylindrical passageway is defined at said pivoting connection, said generally cylindrical passageway configured to accept electrical wiring therethrough.

24. The apparatus as claimed in claim 21, wherein said pivoting connection has an axis passing generally through and parallel to said internal elongate cavity.

25. The apparatus as claimed in claim 21, further comprising releasable lock means for selectively preventing said pivoting movement to occur.

26. The apparatus as claimed in claim 25, further comprising stop means for allowing said pivoting movement to occur about a longitudinal axis within but not exceeding a 360 degree range.

27. The apparatus as claimed in claim 21, further comprising stop means for allowing said pivoting movement to occur about a longitudinal axis within but not exceeding a 360 degree range.

28. An apparatus for providing signals to a train, comprising:

a substantially stationary frame having a substantially tubular portion in the shape of a "T" having a stem and two arms, said stem of the "T" having a lower end being configured for placement at ground level and said two arms of said "T" being generally tubular and extending generally horizontally in opposing directions and terminating in corresponding first and second outwardly-oriented ends;

first and second signal head supporting members independently pivotably attached relative to corresponding said first and second outwardly-oriented ends, said first and second signal head supporting members having tubular portions configured to cooperate with said tubular arms of said substantially stationary frame to provide an elongate cavity to accept electrical wiring therethrough, said elongate cavity partially defined by said stationary frame and partially defined by said signal head supporting members; and first and second signal heads attached to and supported by said first and second signal head supporting members, respectively, such that either of said first or second signal head supporting members may be pivoted without pivoting the other signal head supporting member, to facilitate easier access to the corresponding signal head.

29. The apparatus as claimed in claim 28, wherein said first and second supporting members are first and second T-shaped signal head support frame members.

30. The apparatus as claimed in claim 29, wherein said first and second signal head supporting members pivot about an axis passing through and parallel to said elongate cavity.

31. The apparatus as claimed in claim 28, further comprising:

stop means for allowing said first and second signal head supporting members to pivot about a longitudinal axis within but not exceeding a 360 degree range.

32. The apparatus as claimed in claim 28, wherein said first and second signal head supporting members pivot about an axis passing through and parallel to said elongate cavity.

33. The apparatus as claimed in claim 29, further comprising first and second releasable lock means for selectively preventing said first and second signal head supporting members to pivot.

34. The apparatus as claimed in claim 28, further comprising first and second releasable lock means for selectively preventing said first and second signal head supporting members to pivot.

* * * * *